US006029969A

United States Patent [19]

Saitoh et al.

[11] Patent Number: 6,029,969

[45] Date of Patent: Feb. 29, 2000

[54] AUTOMATIC DOCUMENT FEEDING DEVICE

[75] Inventors: Hidemi Saitoh, Yamanashi-ken; Takahiko Komatsu; Masashi Yamashita, both of Kofu, all of Japan

[73] Assignee: Nisca Corporation, Yamanashi-ken, Japan

[21] Appl. No.: 08/777,028

[22] Filed: Dec. 30, 1996

[30] Foreign Application Priority Data

Dec. 28, 1995 [JP] Japan ..... 7-353614

[51] Int. Cl.[7] ..... B65H 5/22

[52] U.S. Cl. ..... 271/4.02; 271/4.09; 271/265.02; 271/301; 271/303; 271/186; 271/902; 399/370; 399/371

[58] Field of Search ..... 271/3.15, 3.16, 271/3.19, 3.2, 3.21, 4.01, 4.02, 4.09, 10.02, 10.05, 10.1, 265.02, 301, 303, 298, 186, 902; 399/370, 371, 372, 373, 377

[56] References Cited

U.S. PATENT DOCUMENTS

| | | | |
|---|---|---|---|
| 5,119,145 | 6/1992 | Honjo et al. | 399/371 |
| 5,280,330 | 1/1994 | Baba | 399/371 |
| 5,323,219 | 6/1994 | Hamanaka et al. | 399/371 |
| 5,506,658 | 4/1996 | Takemura et al. | 399/370 |

FOREIGN PATENT DOCUMENTS

| | | | |
|---|---|---|---|
| 403147670 | 6/1991 | Japan | 271/3.21 |

*Primary Examiner*—H. Grant Skaggs
*Attorney, Agent, or Firm*—Kane, Dalsimer, Sullivan and Levy, LLP

[57] ABSTRACT

Documents to be imaged which lie one upon another in a prescribed order of page on an automatic document feeding device are automatically fed one by one to a scanning reference position defined in an image scanning position of an image processing device and discharged, after being imaged, to a discharge tray in the same order of page as those initially stacked. The document sent out from the image scanning position to a delivery passage after being imaged is sent back to the document scanning position through a return passage to be turned over. When the document being sent back is introduced into the image scanning position by the longitudinal size of the document, document transporting means is reversed to discharge the document, thereby to shorten the time required to discharge the document from the image scanning position to the discharge tray through a document discharge passage. The documents after being imaged can be discharged in the desired order of page on the discharge tray by turning over the documents before being discharged.

11 Claims, 9 Drawing Sheets

AUTOMATIC DOCUMENT FEEDING DEVICE

BACKGROUND OF THE INVENTION

1. Field of the Invention

This invention relates to a document feeding device for automatically feeding and discharging documents to and from image processing devices of various sorts, and more particularly to an automatic document feeding device capable of transporting documents lying one upon another in order of page one by one at high speed from a document supply mechanism to an image scanning position of the image processing device and sending out the document from the image scanning position to a document discharge mechanism after completing image processing so as to resultantly put the discharged documents one on top of another in the same order of pages as the documents initially placed on the document supply mechanism.

2. Description of the Prior Art

There have been widely used systems having a document feeding device placed on the image scanning position of an image processing device such as a copying machine, facsimile and image scanner, which deals with documents or originals printed with characters and/or graphics, to automatically carrying out consecutive processes of feeding and discharging the documents one by one relative to the image processing device.

The documents placed on a document supply tray of the document feeding device are sent off one by one toward the image scanning position of the image processing device so as to be sent out in the sequence of the uppermost document to the lower documents or vise versa of the documents stacked on the tray. When feeding the document to the image scanning position, there is a case that the document must be turned over according to the state in which the image surface of the document on the document supply tray faces upward or downward.

An explanation of the sequence of transporting documents by the document feeding device will be given with reference to FIG. 1 shown by way of one example. The document feeding device ADF is openably mounted on an image processing device M so as to be overlaid on a platen made of transparent glass or the like which serves as the image scanning position defined on the upper surface of the image processing device. The document feeding device comprises a document supply mechanism 1 for sending off documents Dn ($n \geqq 1$) stacked on a document supply tray 1*a*, a document transport unit 2 for moving the document from the document supply mechanism 1 to an image scanning position R defined on the platen, and a document discharge mechanism 3 for sending out the document from the image scanning position R to a document discharge tray 3*a*.

The documents D1 to D3 placed on the document supply tray 1*a* are sent off one by one and introduced into a supply passage p1 by rotating a feed roller 1*b* in the document supply mechanism 1, so that one document is fed into the image scanning position R defined between the document transport unit 2 and the platen P. The document after being imaged at the image scanning position R is discharged to the document discharge tray 3*a* through a delivery passage p2.

The document supply tray 1*a* is disposed above the document discharge tray 3*a* for the purpose of increasing a space factor of the device. Therefore, when the documents Dn are stacked on the document supply tray 1*a* with their image faces f downward as illustrated, and at the outset, the lowermost first document D1 is first fed to the image scanning position over the platen P through the supply passage 1*a* of the document supply mechanism 1, the image face of the document arriving at the image scanning position faces upward as indicated by dx1 in the illustration. Thus, the document to be fed to the image scanning position should be turned upside down.

To turn over the document, the document is usually moved through a round route formed of the delivery passage p2 and a return passage p3 and sent back to the upper surface of the platen, as indicated by the arrow a in the illustration. Otherwise, the document once arriving at the image scanning position may be sent back to the document supply passage p1 of the document supply mechanism 1 to be turned over there.

The document dx2 sent back to the upper surface of the platen through the return passage p3 is placed there with the image face f downward while locating the leading end thereof at a scanning reference point PX. In this state, the desired image processing is carried out.

The document after being imaged at the image scanning position is discharged to the discharge tray 3*a* through the delivery passage p2. However, if the document is discharged as it is, the image face f of the document faces upward on the discharge tray 3*a*, and succeeding documents D2 and D3 are similarly sent out on the top of the document D1 on the discharge tray 3*a*. As a result, the order of page of the documents discharged to the discharge tray is reverse to that of the documents initially stacked on the document supply tray. To surmount such a disadvantage, the document dx2 after being imaged pursues the same course indicated by the arrow a to move through the delivery passage p2 and the return passage p3 to the upper surface of the platen, and then, be sent out through the delivery passage p2 and a discharge passage p4 to the discharge tray 3*a*. Consequently, the documents Dn can be discharged to the discharge tray 3*a* with their image faces downward in the same order of page as those initially stacked on the document supply tray.

Even though the documents are initially placed with their image faces upward and sent out in sequence from the uppermost document, the documents after being imaged are inevitably required to be turned over as shown by the arrow a in the illustration.

Since the document feeding device cannot however determine a lead-in distance by which the document must be returned onto the upper surface of the platen along the returning course indicated by the arrow a in the illustration, there will be commonly thought out an idea of returning the document delivered through the returning course until the leading end of the document arrives at the scanning reference point PX (position at which the document dx2 is placed to be imaged), and yet, the document of a smaller size than the maximum size which can be dealt with by the document feeding device must be excessively returned more than it needs, thereby decreasing the feeding efficiency and reducing the operation speed of the document feeding device, because the platen is generally designed according to the size of the maximum document. That is, in some general cases, the image processing device such as a copying machine can deal with documents of A3-size (29.7 cm×42 cm) at a maximum, but documents of A4-size or letter size smaller than the maximum size would be usually used with considerable frequency. Hence, it is irrational that the document of A4-size is transported from one end to the other end of the image scanning position having a longitudinal length equal to or larger than A3-size, as a result of which the operation speed of the document feeding device is disadvantageously reduced.

OBJECT OF THE INVENTION

An object of the present invention is to provide an automatic document feeding device capable of transporting one by one documents stacked in the prescribed order of page on a document supply mechanism to a scanning reference point determined on an image scanning position of an image processing device, and discharging the documents after being imaged to a document discharge mechanism in the same order of page as those initially stacked on the document supply mechanism.

Another object of the invention is to provide an automatic document feeding device capable of automatically performing high-speed delivery and discharge of the documents relative to the image processing device.

Still another object of the invention is to provide an automatic document feeding device capable of automatically recognizing the size of a given document to be imaged and transporting the document through a shortest possible passage conforming to the size of the document so as to perform the delivery, turnover and discharge of the document with high efficiency.

SUMMARY OF THE INVENTION

To attain the objects described above according to the present invention, there is provided an automatic document feeding device comprising a document supply mechanism for supplying documents to an image scanning position having one end serving as a scanning reference point of an image processing device, a document transport unit for moving the document along the image scanning position, a document discharge mechanism for discharging the document from the image scanning position, which discharge mechanism includes a return passage for turning over the document from the image scanning position, and means for controlling the document transport unit and the document discharge mechanism so as to send back the document upon sending the document turned over by the return passage to the image scanning position by the lead-in distance corresponding to the size of the document.

The document supply tray of the document supply mechanism and the discharge tray of the document discharge mechanism are disposed above the image scanning position, so that the document is transported from the document supply tray to the image scanning position through a substantially semicircular supply passage, and then, discharged from the image scanning position to the document discharge tray through substantially semicircular delivery and discharge passages. The document is turned upside down when arriving at the image scanning position, but resumes its original posture when discharged to the document discharge tray.

The document supply mechanism is provided with a document size sensor for detecting the document traveling along the document supply passage to recognize the size of the document.

If the document sent from the document supply mechanism to the image scanning position faces upward, it is sent out to the document discharge mechanism before being imaged, and again returned to the image scanning position through the return passage to turn its image face downward. Then, the document is delivered to the scanning reference point and scanned there to be imaged.

The document after being imaged is forwarded to the document discharge mechanism and again sent back to the image scanning position through the return passage, thereby to be turned over. The document transport unit is controlled by the controlling means to move the document backward so that the lead-in distance of the document sent back into the image scanning position becomes substantially equal to the length of the document which is detected by the document size sensor.

Since the lead-in distance by which the document is returned can be minimized, the document can be discharged at high speed with high efficiency.

The documents are discharged in sequence to the discharge tray with their image faces downward, thus to secure the same order of page as the documents initially set on the document supply tray.

Other objects and features of the present invention will be hereinafter described in detail with reference to the accompanying drawings.

DESCRIPTION OF THE PREFERRED EMBODIMENTS

Figure 1:
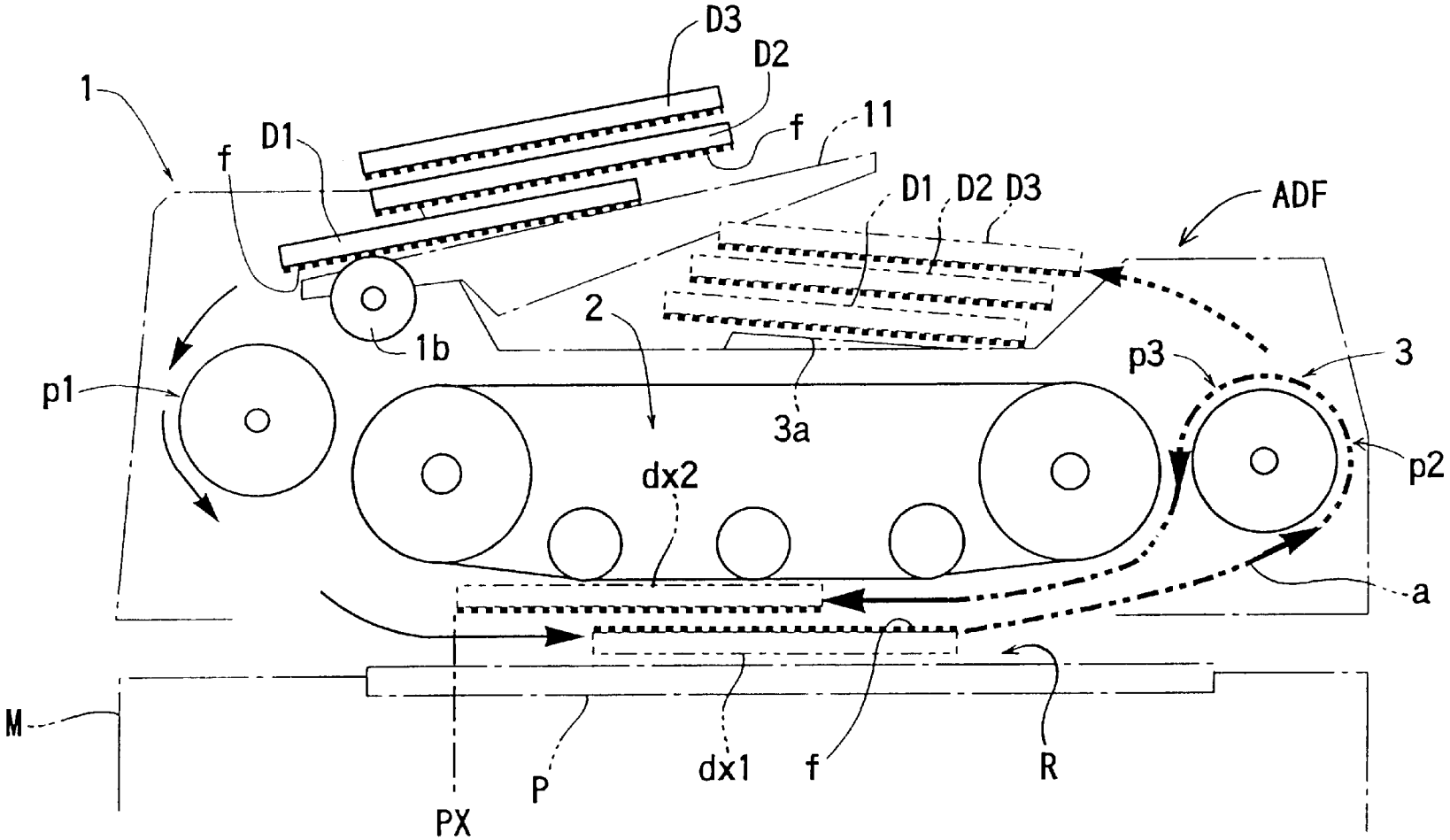
FIG. 1 is a conceptual view explanatory of the state of transporting documents relative to an image scanning position defined on an image processing device.
Figure 2:
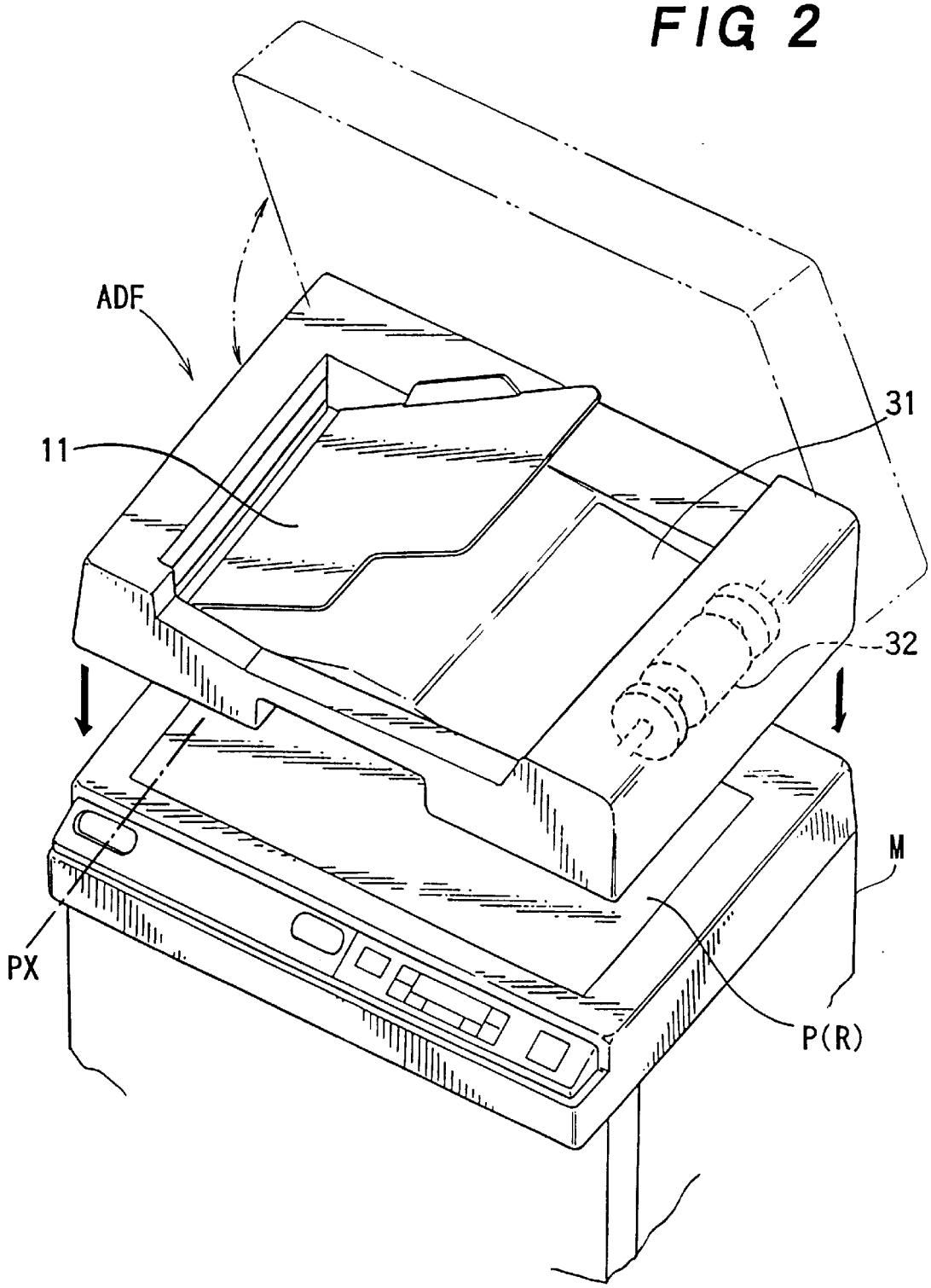
FIG. 2 is a perspective view schematically showing one example of a document feeding device of this invention which is applied to the image processing device.

The present invention provides an automatic document feeding device for handling image documents to be processed by various image processing devices such as a copying machine, facsimile and image scanner, which has a function of feeding and discharging given documents or originals relative to an image scanning position with high efficiency. Shown in FIG. 2 is a copying machine by way of one example of the image processing device M to which the document feeding device of the invention is attached.

As illustrated, the automatic document feeding device ADF of the invention is superposed on the image processing device M so as to openably cover a platen P made of transparent glass on which an image scanning position R is defined. In general, the document feeding device is pivotally mounted on the image processing device M by use of hinge means (not shown). The dimension of the image scanning position R is equal to or somewhat larger than the size of the maximum document which can be handled by the image processing device. The explanation of the device of the invention will be made here assuming that the size (longitudinal length in the document forwarding direction) of the platen P is determined to the longitudinal length of a sheet of A3-size (29.7 cm×42 cm) which is the maximum size ordinarily handled by a common copying machine, but the documents of A4-size or letter size smaller than that the maximum size are used most frequently in the image processing device.

The automatic document feeding device ADF comprises a document supply mechanism 10 having a document supply tray 11 on which one or more documents D1, D2 . . . (Dn; n≧1) to be imaged by the image processing device, a document transport unit 20 superposed on the platen P of the image processing device, and a document discharge mechanism 30 having a document discharge tray 31.

The document supply mechanism 10 is adapted for supplying the documents Dn stacked on the document supply tray 11 one by one to an image scanning position R defined between the platen P and the document transport unit 20 through a document supply passage p1 formed in a substantially semicircle.

Figure 3:
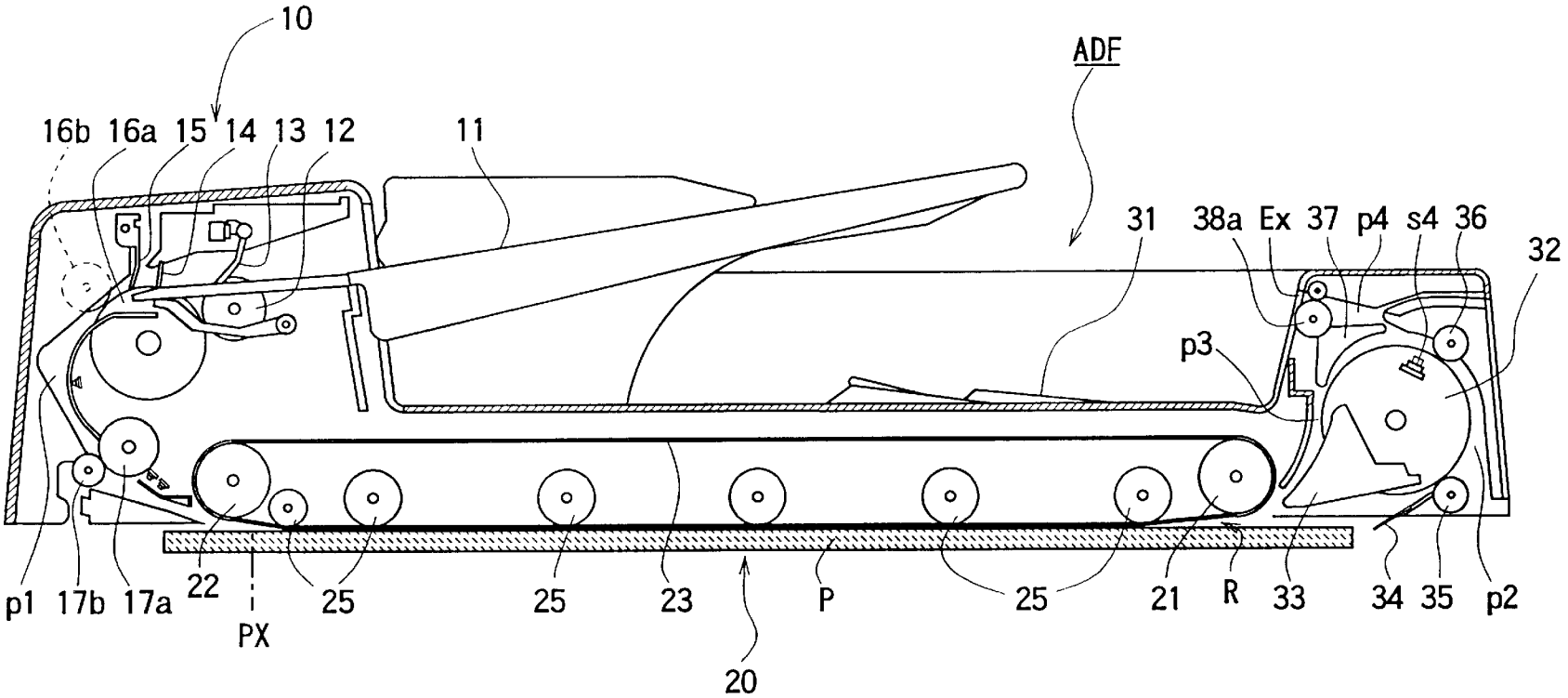
FIG. 3 is a side sectional view schematically showing one embodiment of the document feeding device according to this invention.
Figure 4:
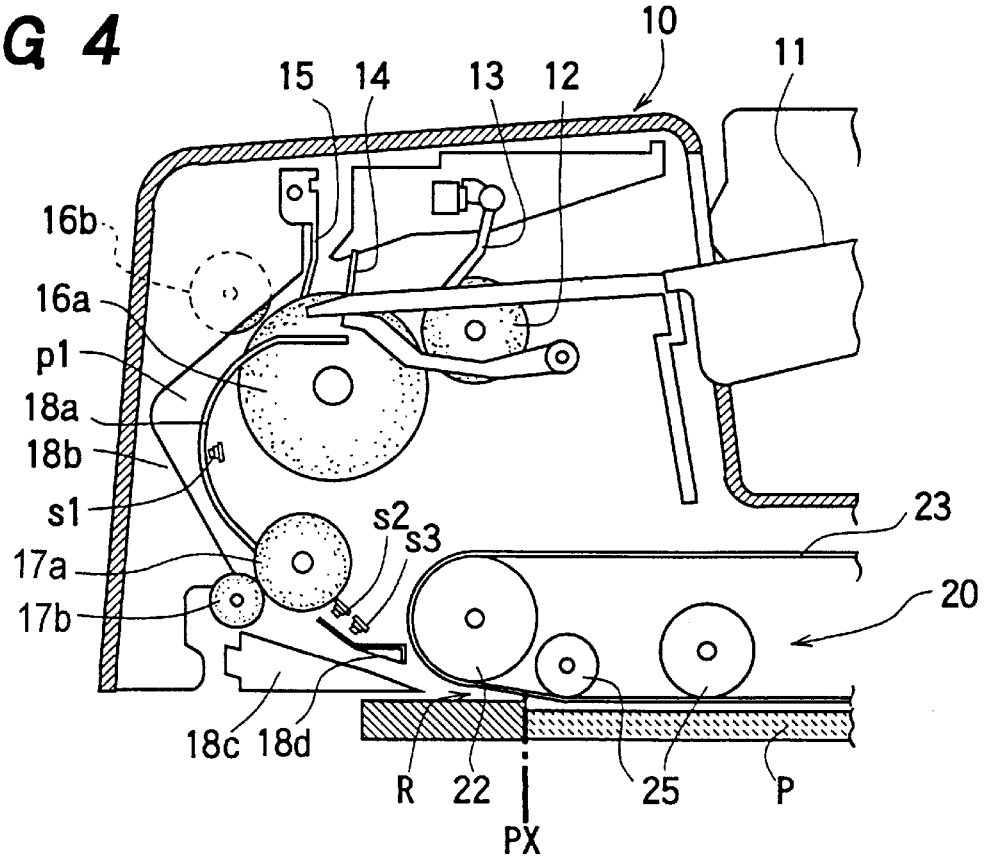
FIG. 4 is an enlarged side section of a document supply mechanism in the device of FIG. 3.

As shown in FIG. 3 and FIG. 4, the document supply mechanism 10 includes a kick roller 12 for sending off one of the documents Dn stacked on the document supply tray 11, an empty sensor 12 for detecting the document on the document supply tray 11, a gate means 14 which assumes its upper position on standby to restrain the documents on the document supply tray from advancing and retracts downward to allow the document to pass therethrough upon reception of a feeding instruction, a document scraper 15 made of elastic material for preventing two or more documents from passing therethrough, paired separation rollers 16*a* and 16*b* for separating two or more documents possibly passing through the document scraper 15 to permit only one document to pass, and paired register rollers 17*a* and 17*b* for making skew correction of the document traveling along the document supply passage p1. Denoted by 18*a* to 18*d* are guide members which constitute the document supply passage pl.

The kick roller 12, separation rollers 16*a* and 16*b*, and register rollers 17*a* and 17*b* are arranged along the semicircularly curved supply passage p1, so that the documents stacked on the supply tray 11 are sent off one by one in the sequence from the lowermost document to the upper documents through the document supply passage p1 and delivered to the image scanning position R under the document transport unit 20.

Between the paired separation rollers 16*a*, 16*b* and paired register rollers 17*a*, 17*b*, there is disposed a document sensor s1 for determining the length of the document traveling along the document supply passage p1 and timing with which the register rollers 17*a* and 17*b* are operated. On the downstream side of the register rollers 17*a* and 17*b*, there are disposed a sensor s2 for detecting the width of the document passing therethrough, and a timing sensor s3.

The structures and arrangement of the kick roller 12, empty sensor 13, gate means 14, document scraper 15, separation rollers 16*a* and 16*b*, and register rollers 17*a* and 17*b* are not specifically limited, and any other elements may be used instead. For instance, although document separating means is composed of a pair of rollers in the illustrated embodiment, the separation roller 16*b* may be replaced by an elastic friction pad or plate, while using the separation roller 16*a* on the driving side. Also, a plurality of document scrapers may be disposed along the document supply passage to increase the function of preventing a plurality of documents from passing therethrough. In these manners, these component elements of the device may be modified variously.

Figure 6:
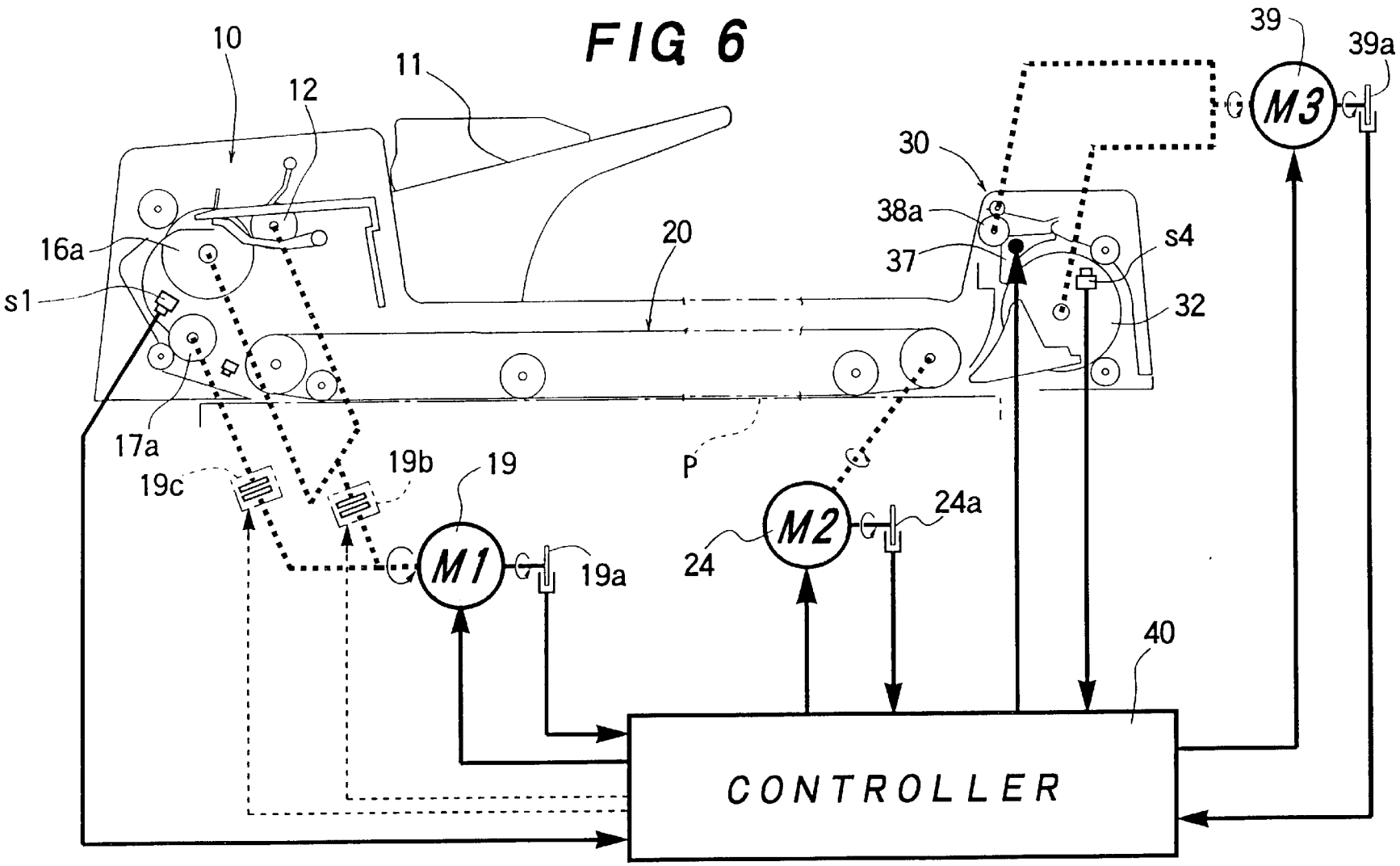
FIG. 6 is an explanatory view schematically showing a control system for the document feeding device of the invention.

The kick roller 12, separation roller 16*a*, and register roller 17*a* are commonly driven by a document supplying motor (M1) 19 as illustrated in FIG. 6. The motor 19 is provided on its rotary shaft with a rotation detector 19*a* such as a pulse generator or pulse encoder which generates pulses in accordance with the rotation of the motor, to measure the rotational momentum of the motor 19. Between the motor 19 and the separation roller 16*a*, there is incorporated a one-way clutch 19*b* for transmitting the one-direction rotation made by the motor 19 to the separation roller, and between the motor 19 and the register roller 17*a*, there is a one-way clutch 19*c* for transmitting the reverse rotation made by the motor 19 to the register roller 17*a*. Thus, either of the separation roller 16*a* and register roller 17*a* is driven to rotate as the motor 19 rotates.

The document transport unit 20 incorporates reversible driving roller 21 and driven roller 22, and transporting means 23 formed of at least one endless belt suspended between the driving and driven rollers, so that the transporting means 23 comes into contact with the platen P when the document feeding device ADF is overlain on the image processing device M.

The driving roller 21 is driven by a reversible transporting motor (M2) 24 as shown in FIG. 6. The motor 24 is provided on its rotary shaft with a rotation detector 24*a* such as a pulse generator or pulse encoder which generates pulses in accordance with the rotation of the motor, to measure the rotational momentum of the motor 24.

The document moves along the image scanning position R formed between the transporting means 23 and the platen P with the rotation of the driving roller 21. That is, by driving the motor 24 so as to selectively rotate in a forward direction or reverse direction, the document placed in the image scanning position R can be arbitrarily moved along the platen P in the forward direction (rightward direction in FIG. 3) or the reverse direction (leftward direction).

Denoted by 25 in the drawings are press rollers for resiliently urging the transporting means 23 against the platen P.

The document discharge mechanism 30 includes a document discharge roller 32 around which the delivery passage p2 is formed along substantially one half of circumferential surface thereof and the return passage p3 along the other half of circumferential surface.

At a bifurcation point j of the image scanning position R between the platen P and transporting means 23, the delivery passage p2 and the return passage p3, there is disposed a director member 33 to connect the image scanning position R with the delivery passage p2 and the return passage p3, respectively. To put it concretely, at the bifurcation point j, one end of the delivery passage p2 has one end communicating with the image scanning position R, and the other end communicating with one end of the return passage p3, and the return passage p3 communicates at its other end with the image scanning position R.

In the drawings, elements g1, g2 and g3 are guide members for forming the delivery passage p2, return passage p3, and discharge passage p4, respectively.

Along the delivery passage p2, there are arranged a guiding member 34, pinch rollers 35 and 36, switching means 37 formed of a rocking flapper or the like, which are opposed to the document discharge roller 32. Near a document exit port Ex confronting the document discharge tray 31, there are disposed a discharge driving roller 38*a* and driven roller 38*b*.

Figure 5:
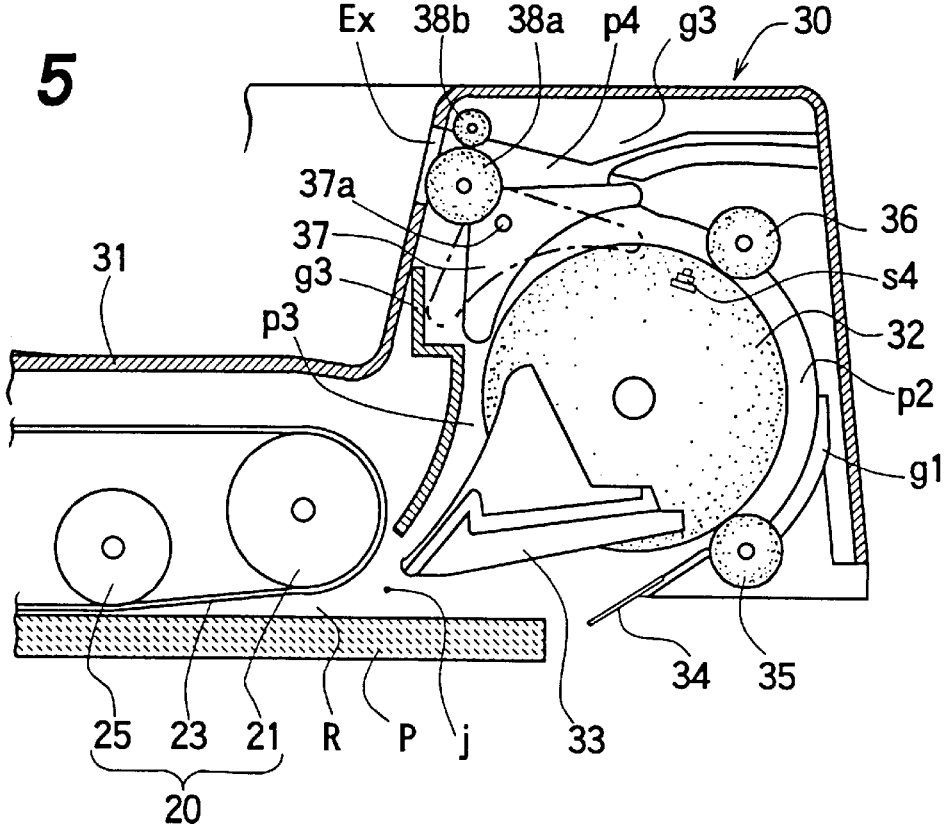
FIG. 5 is an enlarged side section of a document discharge mechanism in the device of FIG. 3.

The switching means 37 is placed at the junction among the delivery passage p2, return passage p3 and discharge passage p4, and rotatable upon an axis 37*a*, so that the document advancing along the delivery passage p2 is selectively forwarded into the return passage p3 leading to the image scanning position R or the discharge passage p4 leading to the exit port Ex. That is, when the switching means assumes the state shown by the solid line in FIG. 5, the document is forwarded from the delivery passage p2 to the return passage p3, and when in the state shown by the imaginary line, the delivery passage p2 is connected with the discharge passage p4, while closing the return passage p3, thus to forward the document along the discharge passage p4.

The discharge roller 32 and discharge driving roller 38*a* are commonly driven by a document discharging motor (M3) 39 as shown in FIG. 6. The motor 39 is provided on its rotary shaft with a rotation detector 39*a* such as a pulse generator or pulse encoder which generates pulses in accordance with the rotation of the document discharging motor, to measure the rotational momentum of the motor 39.

Near the end of the delivery passage p2, there is disposed a discharge sensor s4, so that timing of the operation for returning or discharging the document can be determined in accordance with the size of the document on the basis of the time at which the leading end of the document moving along the delivery passage p2 is detected.

The system described above fulfills efficiently a series of functions of sending off the documents stacked on the document supply tray 11 one by one to the image scanning position R, and discharging the documents to the document discharge tray 31 in the same order of page as the documents initially set on the document supply tray upon completion of the desired image processing at the image scanning position.

Particularly, as shown in FIG. 6, the system incorporates controlling means 40 for fulfilling the aforementioned functions of the system, so as to administer the movements of the document supplying motor (M1) 19 for driving the feed roller 12, separation roller 16*a*, and register roller 17*a*, the reversible transporting motor (M2) 24 for driving the driving roller 21 of the document transport unit 20, the document discharging motor (M3) 39 for discharge roller 32, and the switching means 37.

The operation of the controlling means 40 and the processes of feeding, turning over and discharging the document will be described with reference to the timing chart shown in FIG. 7 and the operating illustrations shown in FIGS. 8A–8F and FIGS. 9A and 9B.

Figure 8A:
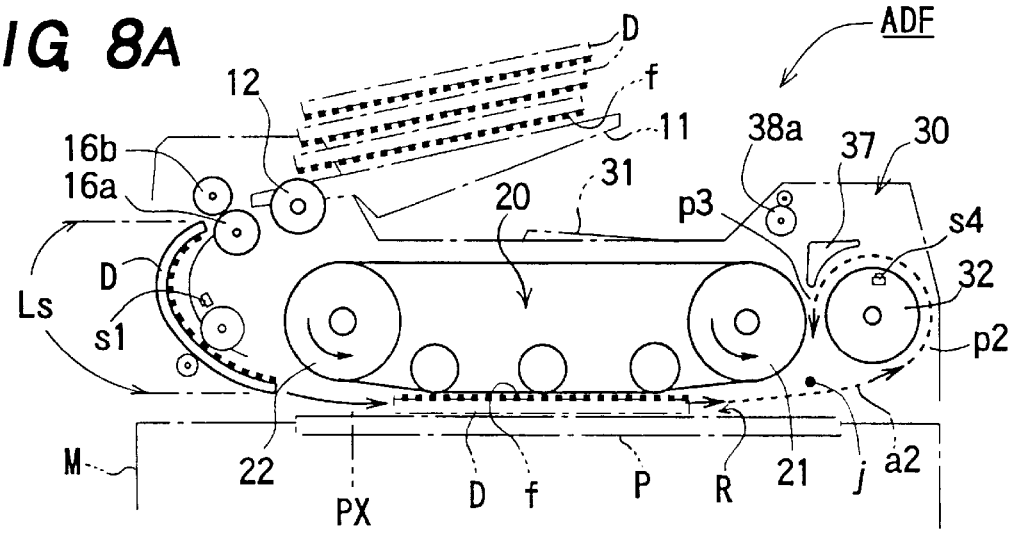
FIG. 8A through FIG. 8F are explanatory views showing the operating principle of the document feeding device of the invention.

FIG. 8A shows the document feeding process in which the documents are stacked with the image face f downward on the document supply tray 11 of the document supply mechanism 10 and sent off one by one so as to forward the first document D drawn out from the stacked documents toward the image scanning position R defined between the platen P and the transporting means 23 through the document supply passage p1.

In the document supplying process, the supplying motor (M1) 19 rotates in the forward direction to send off the document D from the supply tray 11 by the feed roller 12. Since the motor 19 rotates in the forward direction at this time, the separation roller 16*a* simultaneously rotates through the medium of the one-way clutch 19*b* assuming its connected state, but the register roller 17*a* is at rest because the one-way clutch 19*c* is disconnected.

The motor 19 is reversed after a prescribed delay time from detection of the leading end of the document D at the document sensor s1 on the document supply passage p1. The prescribed delay time is so determined that the document moves forward after the document D passes over the sensor and lightly collides with the register rollers 17*a* and 17*b* to slightly bend. Thus, even when the document is sent out slantwise from the document supply tray, the document being forwarded through the document supply passage assumes its proper straight posture (skew correction).

After the lapse of the prescribed delay time noted above, the document supplying motor 19 is reversed. Consequently, the one-way clutch 19*b* is brought to its disconnected state, making the separation roller 16*a* in the free-rotation state, and at the same time, the one-way clutch 19*c* is brought to its connected state, thus to rotate the separation roller 17*a*. At the same time, the controlling means 40 starts taking count of pulses derived from the rotation detector 19*a* mounted on the motor 19, to recognize the rotational momentum of the motor. The counting of pulses stops when the tail end of the document is detected by the document sensor s1. Hence, the size (length Ls) of the document being forwarded through the document supply passage can be calculated from the number of pulses counted.

Figure 9A:
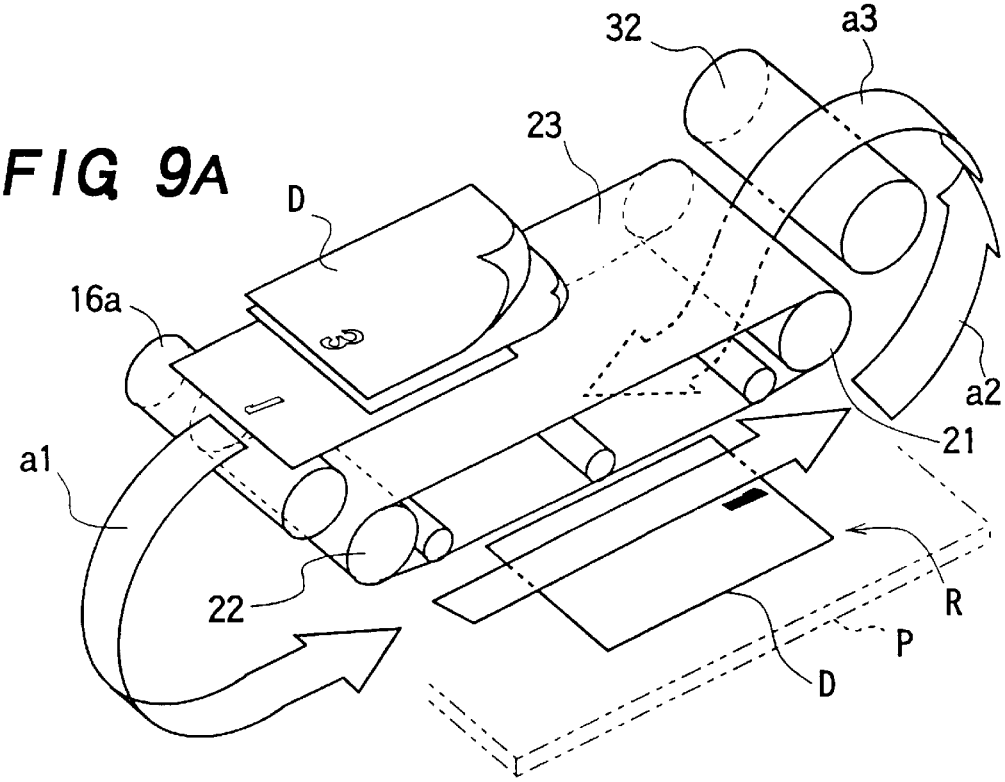
FIG. 9A and FIG. 9B are perspective views showing the operating principle of the document feeding device of the invention.

When the document is stacked with the image face f downward on the supply tray 11, the document D introduced into the image scanning position R faces upward (arrow a1 in FIG. 8A and FIG. 9A). So, in order to turn over the document, the document is sent into the return passage p3 through the delivery passage p2 (arrow a2), and again, introduced into the image scanning position R (arrow a3).

In this turning process, the number of pulses derived from the rotation detector 39*a* of the document discharging motor 39 is counted by starting to take count of pulses issued from the rotation detector 24*a* of the motor (M2) 24 and/or the rotation detector 39*a* of the motor (M3) 39 from the time of detecting the leading end of the document D by the discharge sensor s4. On the basis of the number of pulses counted, the transporting motor 24 is rotated in the reverse direction and the discharging motor (M3) 39 is rotated in the forward direction until the leading end of the document reaches the scanning reference point PX.

Figure 8B:
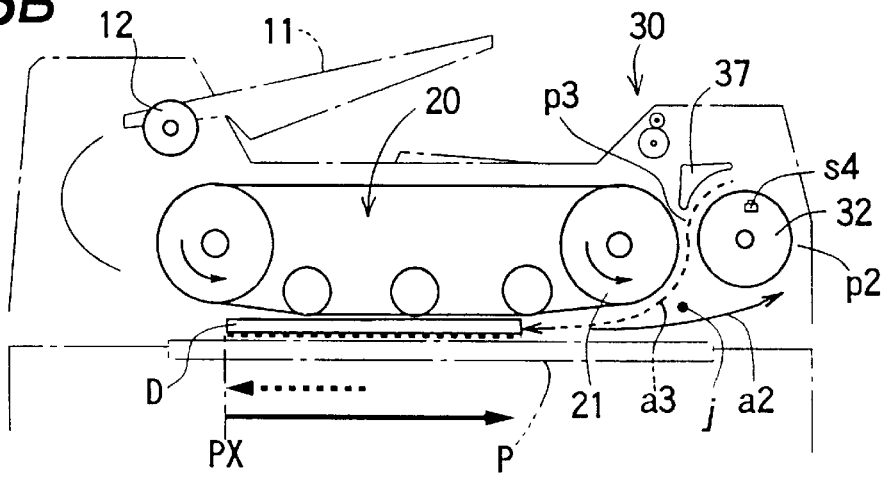

Upon completion of the desired image processing for the document D in the state shown in FIG. 8B, the document D is sent out to the discharge tray 31. However, when the document D facing downward on the image scanning position is discharged to the discharge tray 31 as it is, it faces upward on the discharge tray 31, as a result of which the order of page of the documents discharged in succession and resultantly placed on the discharge tray 31 is reverse to that of the documents initially stacked on the document supply tray. To obviate such an inconvenience, the document is turned over by being again sent from the delivery passage p2 into the return passage p3 as shown by the arrow a4 in FIG. 9B. Then, the document advancing toward the scanning reference point PX turns back when the leading end of the document arrives at a point (distance Lx) short of the scanning reference point and moves along the delivery passage p2 (arrow a5), and then, is discharged through the discharge passage p4 (arrow a6).

Figure 7:
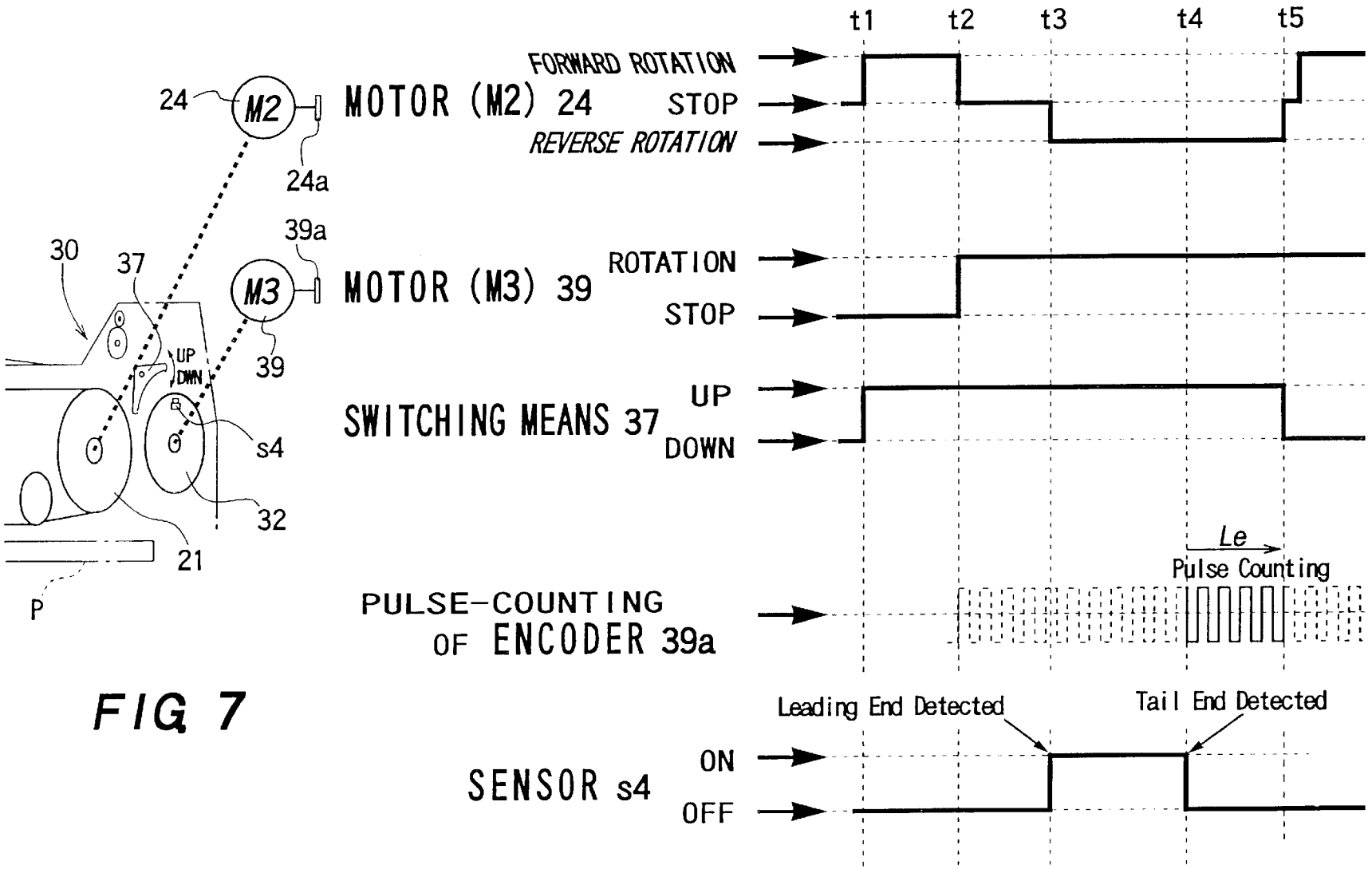
FIG. 7 is a timing chart explanatory of the operation of driving means of the control system of FIG. 6.

That is to say, the transporting motor (M2) 24 starts to rotate in the forward direction at the time t1 in FIG. 7, to send out the document D from the image scanning position R to the discharge mechanism 30. At the same time, the switching means 37 is actuated upward to connect the delivery passage p2 with the return passage p3 and close the discharge passage p4.

Figure 8C:
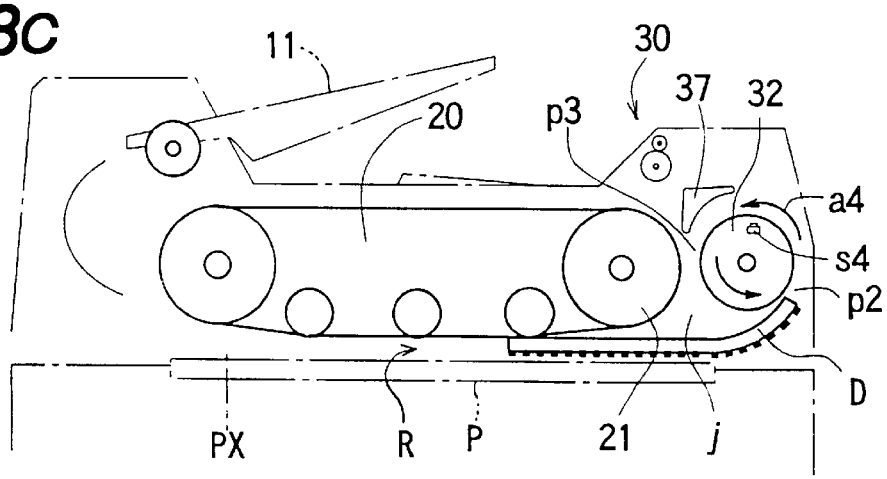

When the prescribed time (t1–t2) elapses, the transporting motor (M2) 24 stops, and the discharging motor (M3) 39 starts to rotate (t2). At the time of t2, the document D is pulled at its front part by the discharge roller 32 to be moved forward along the delivery passage p2. At this time, the rear part of the document D is partially restrained by the transporting means 23 at rest as shown in FIG. 8C, but the document D is dragged by the rotating discharge roller 32 and introduced into the delivery passage p2.

Figure 8D:
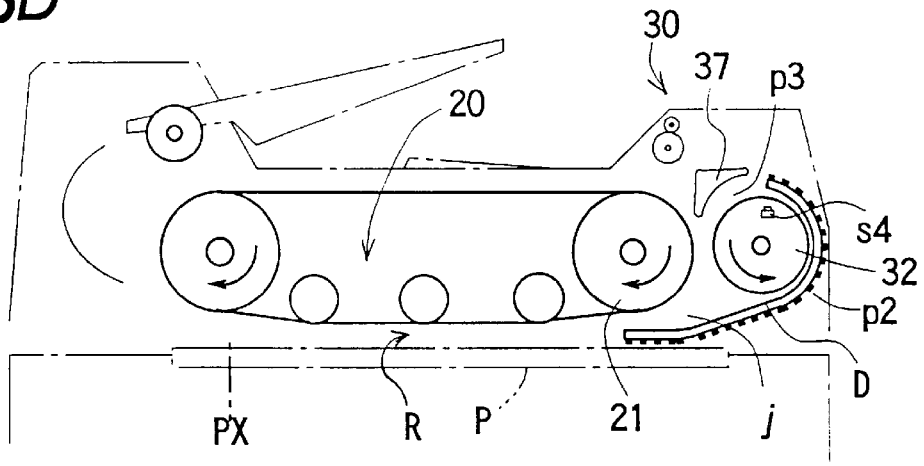

When the document D advancing along the delivery passage is detected by the discharge sensor s4 as shown in FIG. 8D, the transporting motor (M2) 24 is reversed (t3). At this time, even if the rear part of the document D is partially restrained by the transporting means 23, the document D is pulled by the discharge roller 32 to be forwarded to the return passage p3 through the delivery passage p2.

Figure 8E:
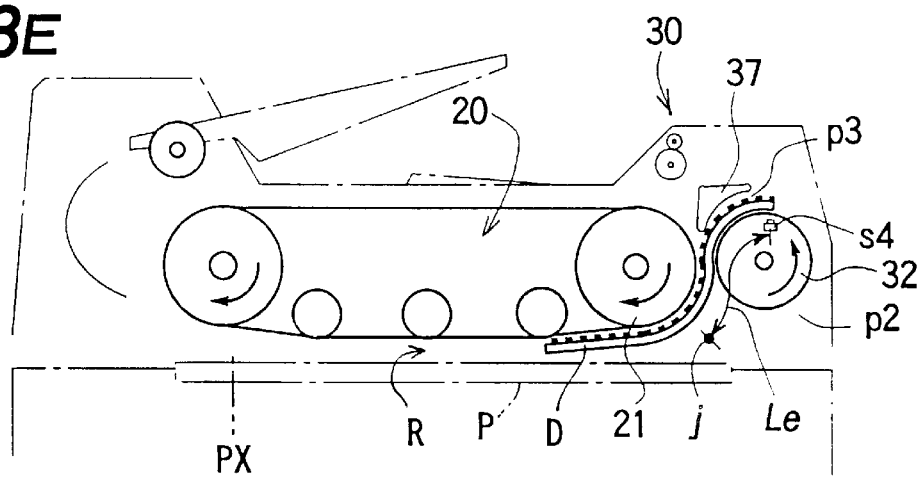

When the document D further advancing along the return passage leaves the discharge sensor s4 as shown in FIG. 8E (t4), the rotation detector 24*a* of the motor (m2) 24 or the rotation detector 39*a* of the motor (M3) 39 starts to take count of pulses, so that the transporting motor (M2) 24 is temporarily stopped when the prescribed time (t4–t5) passes.

The time (t4–t5) is so determined that the tail end of the document D moves from the discharge sensor s4 to the bifurcation point j. Namely, it corresponds to the time required for moving the end of the document by the length of the return passage p3 between the discharge sensor s4 and the bifurcation point j as indicated by the arrow Le in FIG. 8E. The length of the return passage p3 is a known quantity and equal to the time length Le shown in FIG. 7.

Figure 8F:
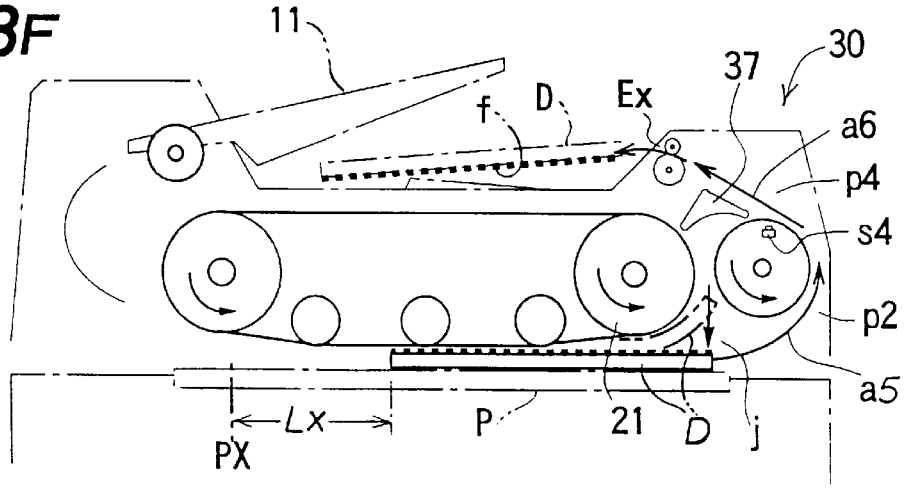

The transporting means 23 is driven to move the document D toward the scanning reference point PX. At this time, the tail end of the document D leaves the discharge sensor s4, while moving the document along the return passage p3 through the bifurcation point j, and then, introducing the document in part into the image scanning position R. Thus, the transporting motor (M2) 24 is driven in the direction opposite to that in which the document is forwarded or discharged. Thereafter, when the tail end of the document D arrives at the bifurcation point j (t5) as shown in FIG. 8F, the motor (M2) 24 is momentarily stopped and then, reversed to rotate in the forward direction.

As a result, the document sent back from the return passage p3 in order to be turned over is introduced into the image scanning position R by the document length shorter than the maximum size which can be handled by the image processing device in most cases. Accordingly, the smaller the document is, the more the processing time is shortened. To more specific, the time required for handling the document shorter than the image scanning position R defined on the platen having the longitudinal length substantially equal to the aforenoted maximum size can be shortened according to the size of the document to be handled.

At the time when the tail end of the document reaches the bifurcation point j (t5), the switching means 37 is switched over to secure the path from the delivery passage p3 to the discharge passage p4. Thus, the document D is sent from delivery passage p3 to the discharge passage p4 and discharged to the discharge tray 31 through the document exit port Ex. At this time, the document D faces downward on the discharge tray, as a result of which the documents discharged in succession after being processed in the same way lie one upon another in the same proper order of page as the documents initially set on the document supply tray.

Although the document moves by the length of the return passage p3, which is a known quantity, after detecting the tail end of the document at the time of t4 in the foregoing embodiment, it may be sent back by the total length (Le+Ls) of the length (Le) of the return passage p3 and the document length (Ls) measured by using the document sensor s1 in the document supply mechanism 10 after the leading end of the document is detected at t3. In this case, the same result can be obtained.

As another measure, the function of turning over the document may be invested in the document supply mechanism instead of the document discharge mechanism. With such document turning means in the document supply mechanism, the document can be turned over in such a manner that the document introduced in part into the image scanning position is sent back to the document supply mechanism before the tail end of the document arrives at the scanning reference point and forwarded into the image scanning position upon turning over the document in the document supply mechanism.

Figure 9B:
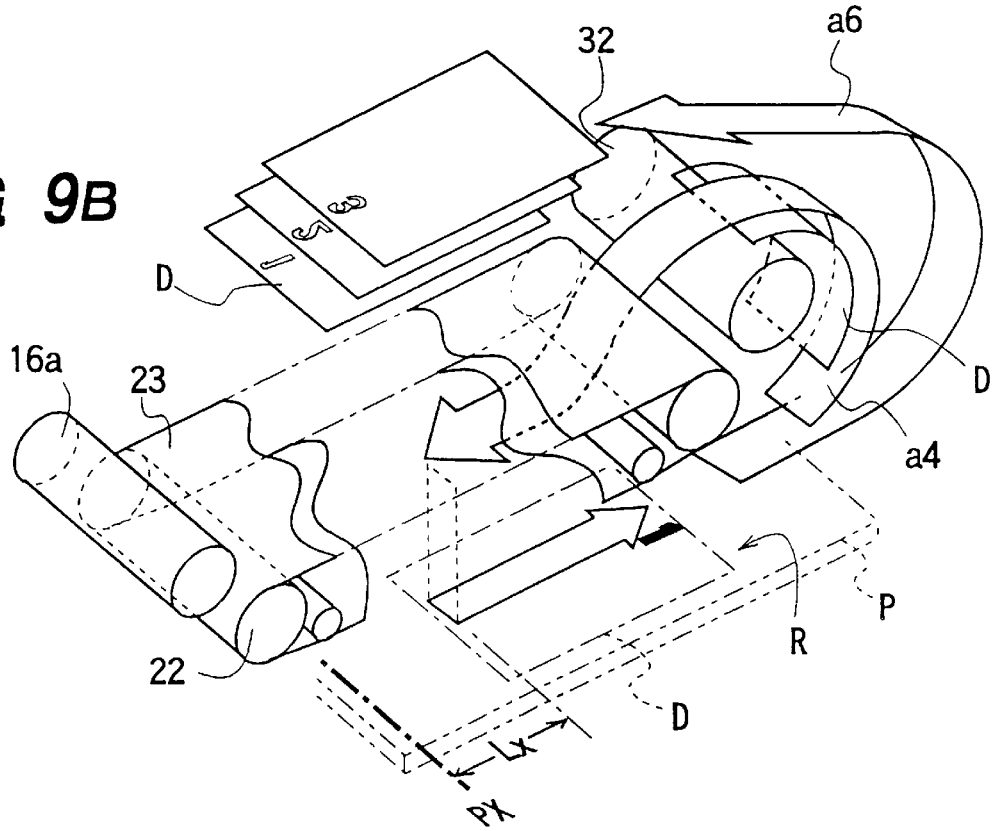

If a document which need not be imaged is fed, it may be discharged along the route indicated by the arrow a6 in FIG. 9B.

As is apparent from the foregoing description, the idea of the present invention is not limited to the specific embodiment described above, and it is needless to say that the device according to the invention can be variously modified in the details of construction in accordance with the condition and structure of various devices and processing manners to which this invention is applicable.

As is described above, according to the present invention, since the document fed to and sent out from the image scanning position is again sent back thereto through the turning mechanism, thus to be turned over, and then, discharged through the discharge passage, the documents can be discharged in succession to the discharge tray in the same order of pages as the documents initially set on the document supply mechanism while carrying out the desired image processing. Besides, since the document turned over by the turning mechanism is sent back into the image scanning position by the length of the document and then reversed to be discharged through the delivery passage, the lead-in distance by which the document is introduced into the image scanning position when being sent back to be turned over can be lessened to a minimum. Thus, high-speed delivery and discharge of the document to be imaged can be achieved. On condition that the longitudinal length of the image scanning position defined on the platen is determined to the size of a maximum document which can be handled by the image processing device, the function of transporting the document with high speed is brought about when dealing with the document having the small size relative to the maximum document, which is most frequently used in general. Furthermore, the invention can provide a document feeding device of enhanced performance capable of automatically measuring the size of the given document so as to efficiently forward, send back and discharge the document by its shortest possible distance.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An automatic document feeding device for automatically feeding one or more documents, each having a size, one by one to an image scanning position having one end serving as a scanning reference point of an image processing device, said automatic document feeding device comprising:

a document supply mechanism having a document supply tray on which the documents to be imaged are stacked, a supply passage through which the documents are sent one by one to said image scanning position, and a document sensor disposed on said supply passage to detect the document traveling through said supply passage and measure the length of the document;

a document transport unit driven by a reversible transporting motor so as to selectively move the document fed from said document supply mechanism in a forward direction or reverse direction along said image scanning position and place the document in position at said scanning reference point;

a document discharge mechanism including a discharge tray a delivery passage connected with said image scanning position at a bifurcation point so as to send out the document from said image scanning position, a return passage having one end connected with said delivery passage and the other end connected with said bifurcation point so as to turn over the document from said image scanning position, and a discharge passage connected with said delivery passage so as to discharge the document from said image scanning position, thereby to selectively introduce the document from said image scanning position into said return passage to turn over said document or said discharge passage to discharge said document;

means for controlling said document transport unit and said document discharge mechanism so as to forward the document to said document discharge mechanism upon sending back the document turned over through said return passage to said image scanning position; and a discharge sensor disposed on said delivery passage of said discharge mechanism to detect the document, whereby the document is sent in the reverse direction until the document arrives at said bifurcation point after passing through said discharge sensor, and reversed to be sent in the forward direction when the document arrives at said bifurcation point.

2. A document feeding device according to claim 1, wherein said transporting motor is provided with a rotation detector for measuring rotational momentum of said motor so as to recognize arrival of the document at said bifurcation point after said tail end of the document passes through said discharge sensor.

3. A document feeding device according to claim 1, further comprising a switching means placed at a junction among said delivery passage, return passage and discharge passage so as to selectively connect said delivery passage with said return passage in turning over the document or said discharge passage in discharging the document.

4. An automatic document feeding device for automatically feeding one or more documents, each having a size, one by one to an image scanning position having one end serving as a scanning reference point of an image processing device, said automatic document feeding device comprising:

a document supply mechanism having a document supply tray on which the documents to be imaged are stacked, a supply passage through which the documents are sent one by one to said image scanning position, and a document sensor disposed on said supply passage to detect the document traveling through said supply passage and measure the length of the document;

a document transport unit driven by a reversible transporting motor so as to selectively move the document fed from said document supply mechanism in a forward direction or reverse direction along said image scanning position and place the document in position at said scanning reference point;

a document discharge mechanism including a discharge tray, a delivery passage connected with said image scanning position at a bifurcation point so as to send out the document from said image scanning position, a return passage having one end connected with said delivery passage and the other end connected with said bifurcation point so as to turn over the document from said image scanning position, and a discharge passage connected with said delivery passage so as to discharge the document from said image scanning position, thereby to selectively introduce the document from said image scanning position into said return passage to turn over said document or said discharge passage to discharge said document;

means for controlling said document transport unit and said document discharge mechanism so as to forward the document to said document discharge mechanism upon sending back the document turned over through said return passage to said image scanning position; and a discharge sensor disposed near a junction among said delivery passage, return passage and discharge passage to detect the document, whereby the document is sent in the reverse direction until the document arrives at said bifurcation point after the document forwarded along said delivery passage passes through said discharge sensor, and reversed to be sent in the forward direction when the document arrives at said bifurcation point.

5. A document feeding device according to claim 4, wherein said transporting motor is provided with a rotation detector for measuring rotational momentum of said motor so as to recognize arrival of the document at said bifurcation point after said tail end of the document passes through said discharge sensor.

6. An automatic document feeding device for automatically feeding one or more documents each having a leading end and a tail end one by one to an image scanning position having one end serving as a scanning reference point of an image processing device, which comprises:

a document supply mechanism having a document supply tray on which the documents to be imaged are stacked, a supply passage through which the documents each having a size are sent one by one to said image scanning position, and a document sensor disposed on said supply passage to detect the document passing through said supply passage and serving to issue an information signal for measuring the size of the document, a reversible transporting motor having a rotation detector for measuring a rotational momentum of said transporting motor, a document transport unit driven by said transporting motor so as to selectively move the document fed from said document supply mechanism in a forward direction or reverse direction along said image scanning position and place the document in position at said scanning reference point, a document discharge mechanism including a discharge tray, a discharge roller having a circumferential surface, a delivery passage formed along a part of said circumferential surface of said discharge roller and connected with said image scanning position at a bifurcation point so as to send out the document from said image scanning position, a return passage having a length and formed along another part of said circumferential surface of said discharge roller, said return passage having one end connected with said delivery passage and the other end connected with said bifurcation point so as to turn over the document from said document scanning position, a discharge passage connected with said delivery passage so as to discharge the document from said image scanning position, thereby to selectively introduce the document from said image scanning position into said return passage to turn over said document or said discharge passage to discharge said document, and a discharge sensor disposed near a junction among said delivery passage, return passage and discharge passage and serving to issue an information signal of the document detected, a document discharging motor for driving said discharge mechanism having a rotation detector for measuring a rotational momentum of said discharging motor, and means for controlling said transporting motor and said discharging motor in accordance with the information signals issued from said document sensor and said discharge sensor.

7. A document feeding device according to claim 6, wherein said length of said return passage is a known quantity, and said transporting motor is driven in the reverse direction until the tail end of the document passing through said discharge sensor advances by the length of said return passage to introduce the document into said image scanning position when sending back the document through said return passage to said document scanning position to turn over the document, and then, reversed when the tail end of the document moves by the length of the return passage and arrives at said bifurcation point so as to drive the transporting motor in the forward direction to discharge the document through said document discharge mechanism.

8. A document feeding device according to claim 7, wherein said rotation detector of said discharging motor is a pulse encoder which generates pulses in response to said motor in rotation, whereby arrival of said tail end of the document at said bifurcation point is recognized by taking count of a prescribed number of pulses corresponding to said known quantity from the time of detecting said document by said discharge sensor.

9. A document feeding device according to claim 6, wherein said length of said return passage is a known quantity, and said transporting motor is driven in the reverse direction until the tail end of the document passing through said discharge sensor advances by the total of said size of the document measured by using said document sensor and said length of the return passage to introduce the document into said image scanning position when sending back the document through said return passage to said document scanning position to turn over the document, and then, reversed when the tail end of the document moves by the length of the return passage and arrives at said bifurcation point so as to drive the transporting motor in the forward direction to discharge the document through said document discharge mechanism.

10. A document feeding device according to claim 9, wherein said rotation detector of said discharging motor is a pulse encoder which generates pulses in response to said motor in rotation, whereby arrival of said tail end of the document at said bifurcation point is recognized by taking count of a prescribed number of pulses corresponding to said total of the size of document and said known quantity from the time of detecting said document by said discharge sensor.

11. A document feeding device according to claim 6, further comprising a switching means placed at a junction among said delivery passage, return passage and discharge passage so as to selectively connect said delivery passage with said return passage in turning over the document or said discharge passage in discharging the document.

* * * * *